1/13/81 OR 4,244,624

United States Patent [19]

Nitzberg

[11] 4,244,624

[45] Jan. 13, 1981

[54] METHOD FOR RECLAIMING HIGHWALLS AT MINING SITES WITH PARTIALLY MINED ORE VEINS

[75] Inventor: Leonard R. Nitzberg, Knoxville, Tenn.

[73] Assignee: Reclamite, Ltd., Knoxville, Tenn.

[21] Appl. No.: 64,558

[22] Filed: Aug. 8, 1979

[51] Int. Cl.[3] ..... E21C 41/00

[52] U.S. Cl. ..... 299/13; 102/23; 299/19

[58] Field of Search ..... 299/11, 13, 19, 12, 299/16, 18; 405/258; 102/23

[56] References Cited

U.S. PATENT DOCUMENTS

| | | | |
|---|---|---|---|
| 1,872,016 | 8/1932 | Sherwood et al. | 299/13 |
| 3,980,339 | 9/1976 | Heald et al. | 299/13 X |
| 4,183,584 | 1/1980 | St. Peter | 299/13 |

FOREIGN PATENT DOCUMENTS

| | | | |
|---|---|---|---|
| 371347 | 6/1973 | U.S.S.R. | 299/13 |

*Primary Examiner*—Ernest R. Purser
*Attorney, Agent, or Firm*—Pitts & Kesterson

[57] ABSTRACT

A method of reclaiming a highwall or sharp cliff like exposure mining site. The method includes the steps of placing a first series of directional charges at preselected locations in each of the auger, longwall or deep mine entry holes proximate the opening of the hole on the face of the highwall. Directional charges are positioned on the floor of the holes and pointed upward, obviating the need to drill charge placement holes. Such solid placement maximizes the explosive impact on the overburden above the charges thereby creating rubble from the overburden and tearing out sections of the in-situ material separating the holes. In one embodiment, a further series of charges is detonated at a preselected interval in time and depth from the detonation of the first series of directional charges to provide a synergistic explosive effect to accomplish the reclamation process.

17 Claims, 8 Drawing Figures

METHOD FOR RECLAIMING HIGHWALLS AT MINING SITES WITH PARTIALLY MINED ORE VEINS

BACKGROUND OF THE INVENTION

This invention relates to a method for reclaiming highwalls at mining sites with partially mined ore veins.

Extraction of coal and other hard minerals from the earth can be accomplished by various methods of surface and subsurface mining. One group of such methods involves the extraction of hard minerals by boring into the seam, at the highwall, without the removal of overburden, such highwall or man made clift, is disposed substantially perpendicular to a flat graded bench area. The bench area is the result of prior surface mining operations. In this method of mining, round, square, rectangular or other configurations of holes are bored into the mineral seam for the purpose of extracting volumes of accessible mineral such as coal.

While coal mining operations contribute significantly to energy requirements, surface mining operations may result in highwall and other disturbances of surface areas that present a hazard to life and adversely affect commerce and the public welfare by destroying or diminishing the utility of land for commercial, residential, recreational and/or agricultural purposes. For example, certain mining sites may result in erosion, landslides, pollute water and the resultant highwalls create hazards to life. Certain government regulations mandate reclamation of highwalls at mining sites, and various steps of reclamation must be taken in order to avoid harsh sanctions. For example, under certain regulations it is necessary to re-establish a natural or stable grade to the top of the highwall. At second cut or orphaned mining sites insufficient spoil or fill dirt may be available to accomplish reclamation. Moreover, it may be necessary or desirous to fill water impoundment areas created by the auger and similar holes closed at the ends opening onto the face of the highwall. These impoundment areas may trap poisonous gases and water which tend to cause delayed land settling, mud slides, pollution, etc. all of which may be injurious to health and/or property. Further, the moving of fill from other extraneous sites for the purpose of filling or covering the highwall may create further ecological damage.

OBJECTS OF THE INVENTION

Accordingly, it is an object of the present invention to provide a method of reclaiming a highwall at surface mining sites which have been partially mined or faulted by auger mining and the like. A further object is to provide a method of reclaiming highwalls at surface mining sites which compiles with the various statutes and regulations governing abondoned mine reclamation. Another object of the invention is to provide a method for reclaiming highwalls at mining sites, which method eliminates various health and property hazards concomitant with the auger holes and the like bored into the face of a highwall. A still further object of the invention is to provide a mining reclamation method which is inexpensive and readily capable of being utilized to remove the highwall and restore a stable grade even at a location lacking sufficient spoil or fill dirt for the refilling process all without the need to dig "barrow" pits in other locations. Yet another object of the invention is to provide a flexible reclamation process which is readily adaptable for site specific application taking into consideration various geological attributes of the mining site. It is also an object of the invention to provide a mining reclamation method which employs strategically placed directional charges for creating rubble from the highwall itself to reclaim the site. Other objects and advantages of the invention will become apparent upon reading the following detailed description together with the drawings which are described as follows:

SUMMARY OF THE INVENTION

In accordance with the illustrated embodiment of the invention, a method for reclaiming a highwall surface mining site is provided which is site specific and may vary to accommodate various geological attributes of the mining site. The method is designed to reclaim highwalls at mining sites having a plurality of holes bored into the coal vein at the face of a highwall and includes the step of placing a series of first directional charges at preselected locations on the floor of the holes proximate the opening of each of such holes. More specifically, one or more rows of those charges are placed in a grid which covers the area, above which the overburden is to be turned into rubble by the shock of the directed blast. The directional charges are exploded to impact the overburden above the directional charge and create rubble from this overburden. The expanding gases, shock and flying debris that constitute the side blast from the series of charges has sufficient force to tear out and/or destroy sections of the pillars or in-situ material between adjacent holes and transform the sections of the pillars into rubble which becomes a part of the blast and are subsequently scattered about the floor of the holes. In one embodiment, employed when overburden at the rearmost section of the holes is thick or would otherwise resist fracturing as a result of the entrapped blast from the first explosion, a second set of explosives is detonated, by means of a time delay fuse immediately prior to the moment the side blast from the first explosion reaches the point at which such second charges are placed. The further series of charges is positioned to maximize the explosive lift on the overburden above each of the further charges, these secondary charges may be directional adding shearing impact to the compressive lift of the charge. This further series of charges is timed in one embodiment such that the expanding gases generated by the further charges counters the expanding gases created by the first charges. This encounter between the first and further expanding gases provides additional upward lift vectors which cause the overburden to lift slightly near the rearward portion of the hole with a resultant dipping of the overburden near the forward portion of hole. The forward edge of the highwall settles and strikes the floor of the hole which in turn transforms the highwall ledge into rubble that serves to fill the portion of the mining site proximate the highwall. With the pillars supporting strength reduced or destroyed by the side blast the overburden is allowed to settle on the floor of the auger holes thereby closing the water impoundment areas. The portions of the mining site proximate the highwall can then be filled and smoothed with minimal grading and covered with soil to complete the reclamation process.

DESCRIPTION OF THE PREFERRED EMBODIMENT

Figure 1:
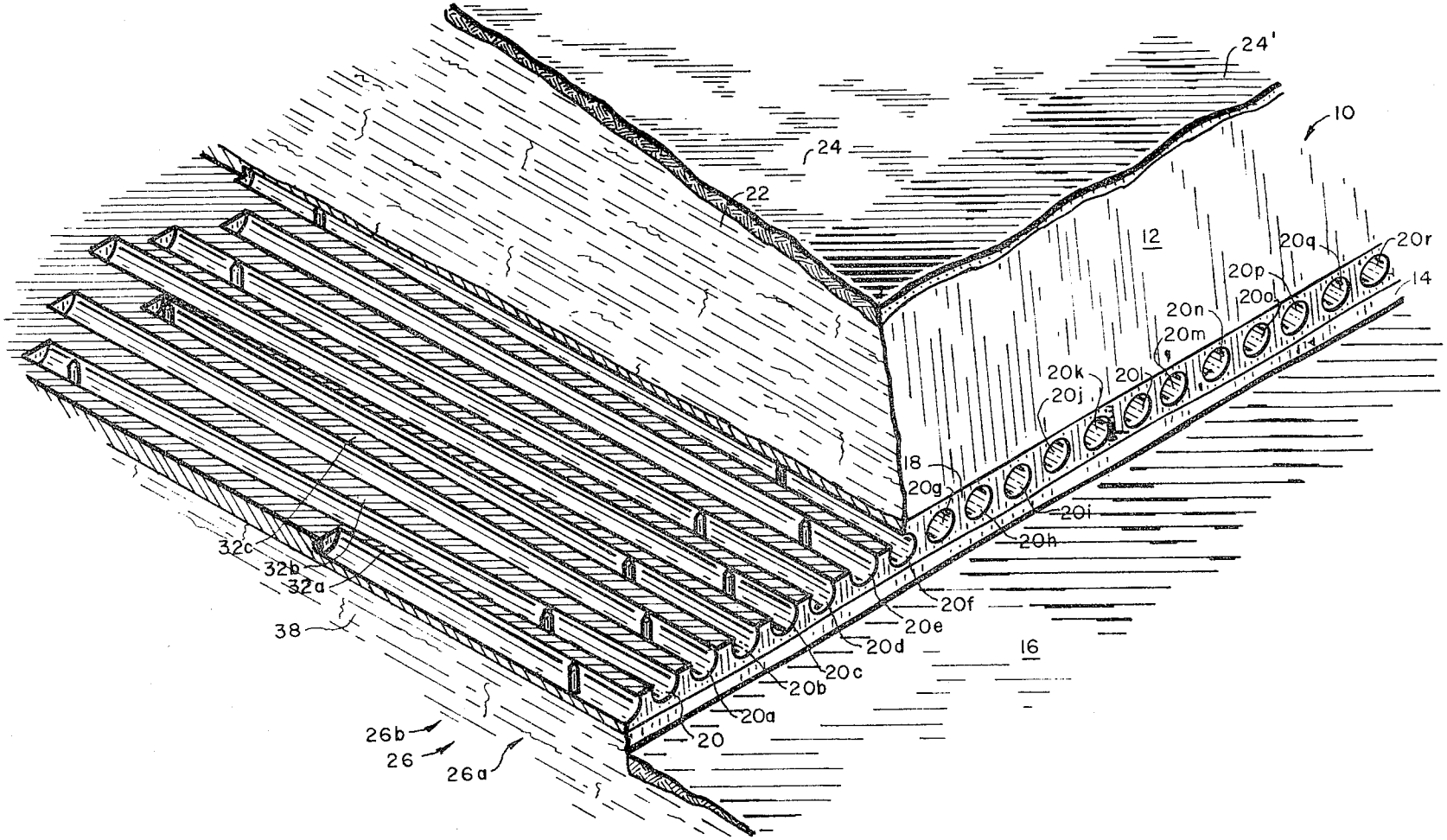
FIG. 1 is a perspective view of a highwall mining site having a portion of the overburden removed to more clearly illustrate the auger holes bored into a mineral seam such as coal.

Referring now to the drawings, a surface mining site with a highwall is generally indicated at 10 in FIG. 1. The mining site 10 includes a highwall 12 having a substantially upright and planar face which joins at its base 14, a substantially planar surface or bench 16 which is graded into the natural contour of the site. This planar surface 16 is the result of overburden and ore removal and serves to support mining equipment and mineral transport vehicles during the mining operation.

A mineral seam or vein such as coal is illustrated at 18. The illustrated seam has been augered or mined in some other manner leaving an undermining or faulted condition. More specifically, a plurality of elongated ore removal holes 20 are bored into the face of the coal seam. The holes 20 A–R are disposed substantially parallel but may slope from the horizontal plane to remain with the coal seam 18 and with respect to each other while extending into the coal seam 18. These holes are voids from which coal has been removed thus establishing the partially mined or faulted condition. Each of the ore removal holes includes one end portion opening on the face of the highwall and an opposite end portion disposed at a preselected depth within the seam, generally at the location of the coal seam "pinched off" or where the cutting tool which formed the hole began cutting material other than coal thereby contaminating the product. As shown in FIG. 1, the depth of the auger holes 20 A–R may vary from location to location. Additionally, the overburden depth may be 250 feet or more at one site and less than 10 feet at another site. Moreover, the overburden may consist of loose dirt at one site and solid rock at another site. In the site illustrated in FIG. 1, the overburden 22 is covered with foilage and top soil 24 and 24'' which may be removed from above the direct blast site area 24' to prevent the foilage from prolonging settling time by being covered during the blast and subsequently loosing volume and/or holding ability due to natural decay.

The reclamation process is accomplished by placing a series of explosive charges at predetermined locations proximate the openings of each of the holes. Each of the charges is directional and is positioned in a grid on the floor of the holes for directing and maximizing the explosive impact on the overburden at a preselected location above each of the charges such that rubble is created from the overburden above each of the charges. As shown in FIG. 1, the series of charges generally indicated at 26 are each placed on a selective ore removal hole floor at a spaced location from the respective hole openings. The illustrated series of charges are staggered and disposed in row **26*a* which is closest to the respective ore removal hole openings and row 26*b* which is disposed farther within the holes forming a grid of explosives over the predetermined area required to create the desired amount of rubble. Normally, this first series of charges 26** is exploded simultaneously or at slight (9 millisecond, for example) delays and the explosive impact of the charges creates rubble from the overburden.

Figure 2:
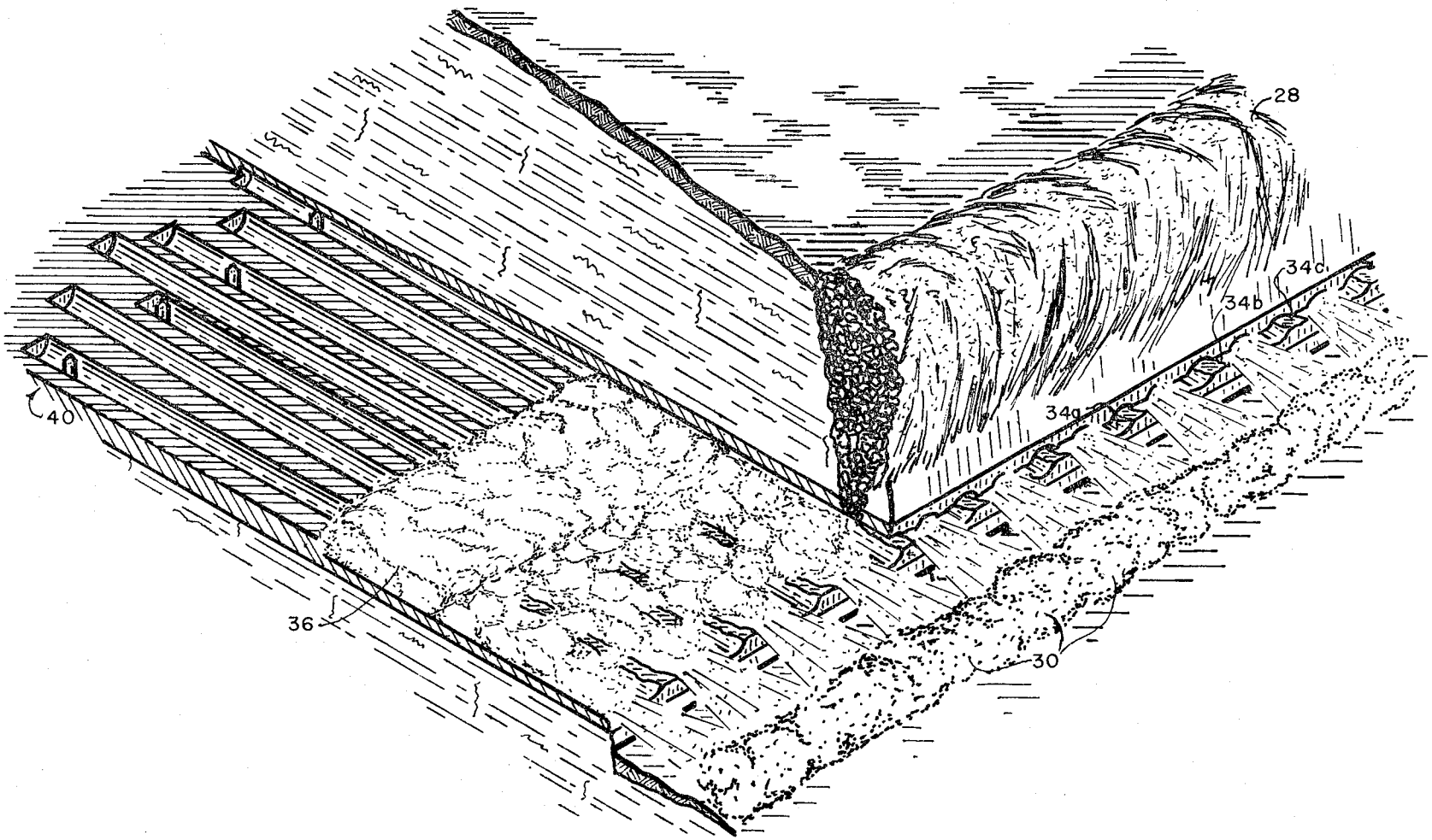
FIG. 2 is a perspective view of the mining site of FIG. 1 subsequent to partial reclamation by detonation of the directional charges proximate the opening or forward end portion of the auger holes.

The effect of the explosion of the front end series of charges 26 is illustrated in FIG. 2. More specifically, as series of charges 26 is exploded rubble 28 is created proximate the face of the highwall as a result of the explosive impact on the overburden. The gases generated as a result of the explosion of the series of charges 26 partially exit the respective openings of the ore removal holes as air blast 30 and serve to tear out sections of the pillars 32 between the adjacent holes as the gases expand sideways. In the embodiment illustrated in FIG. 1, the staggering in grid configuration of the first series of charges serves to increase the impacted area and enhance the shearing forces which tear out the support pillars as illustrated at 34 and further increases the depth of theoverburden destroyed proximate the face of the highwall. The rubble resulting from the detonation of the directional charges against the overburden and the shearing forces on the pillars is scattered about on the hole floors as indicated at 36 in FIG. 2. A portion of the expanding gases side shock and flying debris which constitute the blast resulting from the explosion of the first series of charges moves towards the rearward portion of each of the ore removal holes inasmuch as the blast is confined by the underpinning or support strata on the underside and by the overburden on the top side.

It will be recognized by those skilled in the art that at mining sites where the overburden is loose or thin, the first series of charges will be adequate to create rubble proximate the face of the highwall, destroy the support pillars and fracture the overburden at the rear of the holes allowing the overburden to collapse and thereby eliminate water impoundment areas.

In certain embodiments, for example, where the overburden reaches a thickness of 250 feet or more, the timed explosion of a further series of charges 40 which may be directional to enhance fracturing qualities will provide a synergistic effect when combined with the expanding gases of first series of explosions to tear the support pillars out, create rubble at the openings of the holes and cause a collapse of the overburden sufficient to close the water impoundment areas. More specifically, in the illustrated embodiment the further series of directional charges is positioned in a grid pattern on the floors of each of the ore removal holes to maximize the explosive impact on the overburden above each of the charges. The explosion of the further series of directional charges is timed such that the blast generated encounters the blast generated from the explosion of the first series of directional charges.

Figure 3:
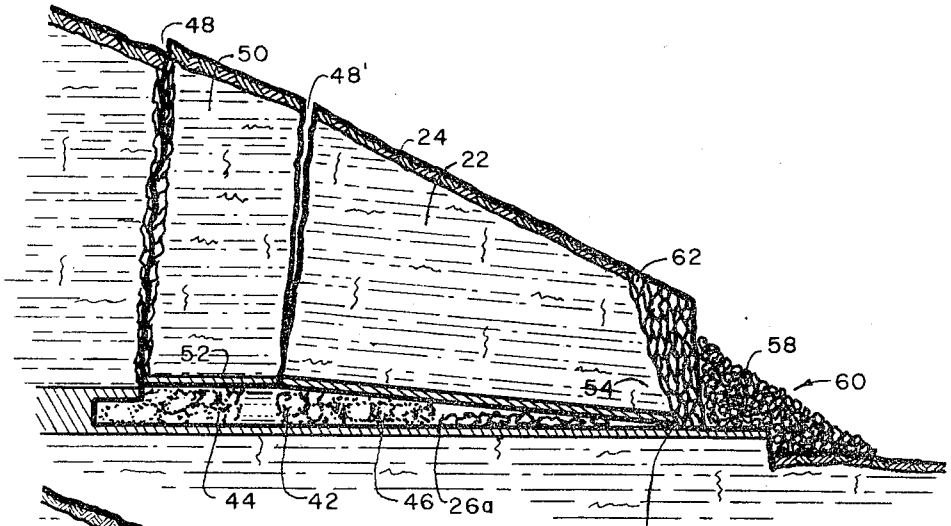
FIG. 3 is a sectional side elevation view of the mining site during the reclamation process and illustrating locations at which the overburden has been sheared.

As shown in FIG. 3, prior to the time the blast reaches the rear portion 42 of the hole **26*a*, the further series of charges is detonated at 44. This further explosion combines with the first explosion blast 46 to provide an enhanced lift vector or vectors on the roof of the ore removal hole proximate the second charges. This lift and any directed impact serves to create the fractures 48 and 48' in certain applications. The rearward portion 50 of the overburden is sheared at the fractures 48 and 48' and rises slightly at 52 causing the front end of the highwall proximate its face to fall as indicated at 54 inasmuch as the support pillars or sections thereof have been previously torn away. As this is occuring, the rubble 58 which had been created from the highwall by the initial blast, settles in a natural slope 60 blocking the holes to prevent escape of additional air blast and providing rubble which can be graded into a stable slope covering the highwall. As the forward portion 54 of the highwall strikes the underpinning or hole floor at 56 additional rubble 62** is fractured from the highwall increasing the volume of rubble available for grading into a stable slope.

As was discussed more generally above, once the blast zones or expanding gases from the first and further series of charges encounter each other, they tend to confine each other and create lift vectors at 52. Moreover, the rubble 58 and the fallen overburden 22 resting on the underpinning at 56 tend to confine the expanding gases such that the air blasts 30 (see FIG. 2) are limited to the initial air blasts resulting from the explosion of charges 26, the blasts from charges 40 being confined. Inasmuch as the air blasts tend to be detrimental to the environment, it is important that these blasts are contained where feasible.

Figure 4:
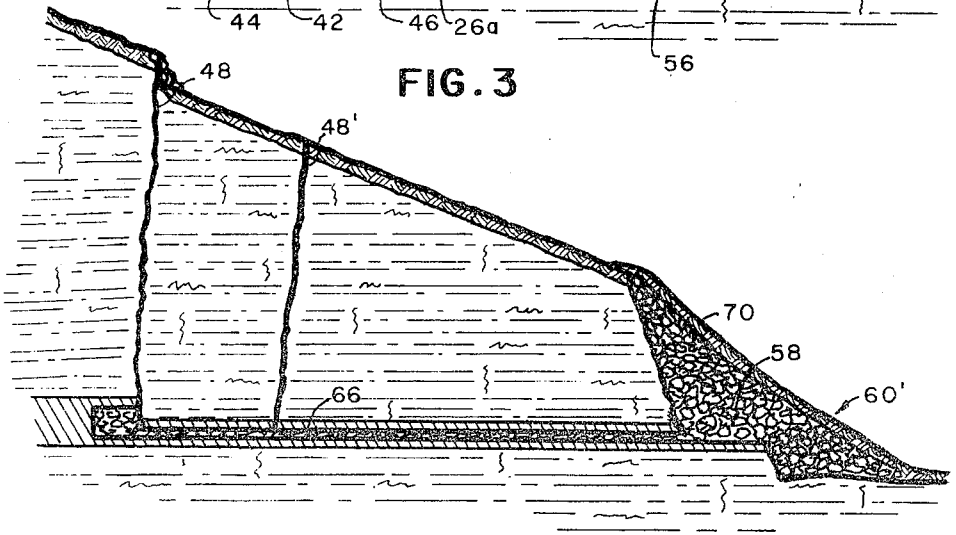
FIG. 4 is a sectional side elevation view of the mining site of FIG. 1 after the reclamation process has been completed.

Referring to FIG. 4, the overburden collapses subsequent to its fracturing at 48 and the destruction of the support pillars which are scattered about the ore removal hole floors as rubble 66. This collapsing of the overburden serves to eliminate the water impoundment areas. Moreover, the highwall can be effectively eliminated by the grading of the rubble 58 into a more clearly defined and stable ramp formation 60' subsequent to the collapse of the overburden. Soil 70 can be graded onto the ramp 60' to complete the reclamation process all without the necessity of digging "barrow" or "bar" pits on adjacent areas.

Figure 5:
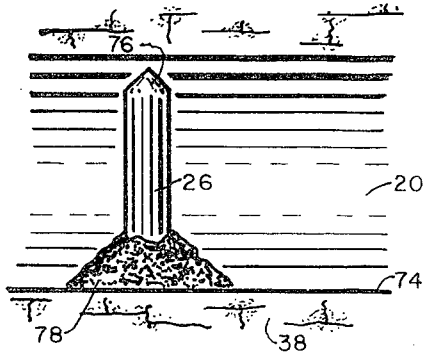
FIG. 5 is an elevation view of a typical directional charge used in the reclamation process.

Referring now to FIG. 5, details regarding a typical directional charge 26 will be explained. The directional charge 26 may be a shaped explosive or any other blasting media which directs its explosive impact in a predetermined direction. The illustrated charge 26 is shown in the ore removal hole 20 and positioned on the hole floor 74 which is the top surface of the underpinning or roofing 38. One suitable directional charge contains nitro carbo nitrate which is an oil impregnated amonium nitrate base explosive. The explosive charge is generally mounted in a cylindrical shipping container with a 66% amonia dynamite or equivalent charge placed on its end 76. As illustrated, the charge is positioned in a substantially upright position, as by proping it with sand or gravel 78. The primer (amonia dynamite in one embodiment) on end 76 is exploded first by a detonating cord or electric cap. The primer in turn detonates the nitro carbo nitrate charge which is detonated by the primer 76 at the top to the floor 74 at a rate of 14,000 feet per second, releasing the major portion of the expanding gases upwardly in the preselected direction thereby maximizing the explosive impact on the overburden 22 at location 80. The initial shock or impact on the overburden at 80, demolishes the overburden by shock and creates rubble therefrom. At that point in time the blast zone or expanding gases, flying rubble and shock created move as described hereinabove.

An alternate step of the method of reclaiming a mining site comprises banking soil 82, rubble or the like as tamping, against the ore removal hole openings after placement of the charges in position in the auger holes. In this connection, the air blast 30 is reduced or eliminated by confining the expanding gases within the ore removal holes, and accordingly less explosive charge is required to tear out the pillars and allow the overburden to collapse.

Figure 6:
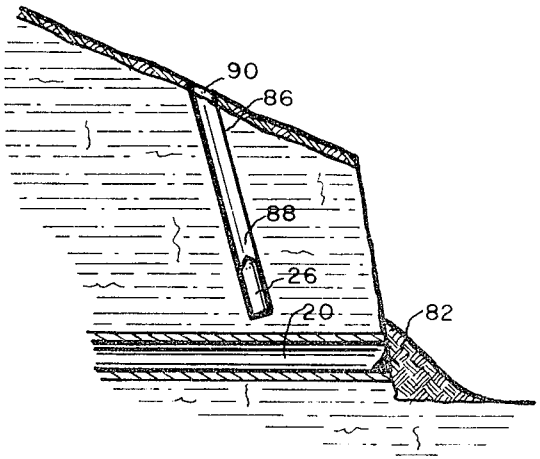
FIG. 6 illustrates alternate steps in the method of reclaiming a highwall.

Another alternate step of the method comprises drilling a blasting media placement hole 86 through the overburden 22 to a preselected depth such that the lower portion 88 of the hole is proximate an ore removal hole 20. A charge 26 is inserted into the hole 86 through the opening 90 at the upper surface of the overburden and positioned at the bottom of the blasting media placement hole near the ore removal hole. The hole 86 is then filled to direct the expanding gases through the portion of the overburden separating the bottom of the hole 86 and the ore removal hole 20. The expanding gases entering the ore removal hole 20 subsequent to detonation of the charge 26 in FIG. 6 then expand as described hereinabove to accomplish the destruction of the pillars.

Figure 8:
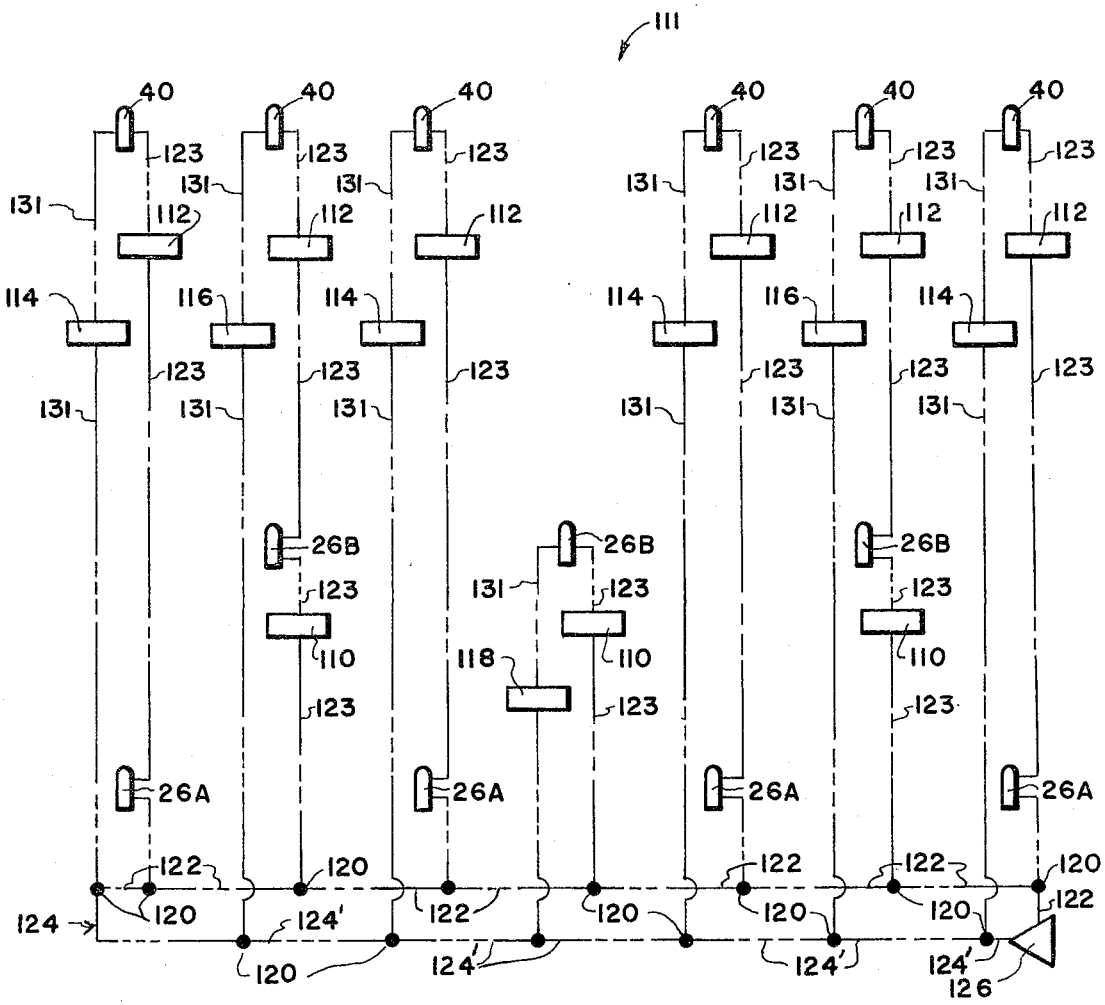
FIG. 8 is diagrammatic illustration of a detonation system for accomplishing the timed explosion of the directional charges.

Referring now to FIG. 8, a detonation system is illustrated which serves to detonate the charges within the holes, and time the detonation in certain instances such that the charges explode at preselected times. The illustrated detonation system 111 includes an electrically ignited detonator 126, which is activated as by manual operation. This detonator 126 is connected through a primary detonation system 113 comprising the primary cord 122 and the branch cords 123 to the charges 26A–B and 40. In the illustrated embodiment typical connections between the primary cord and the branch cords are made at 120 in accordance with accepted practices in the industry. The primary detonation system 113 fires the charges 26A and 26B. In applications requiring delayed explosions, a delay fuse 110 which delays the explosion of the charge connected through the delay fuse to the detonator 126, is inserted in the branch lines between the charge and the detonator. In one embodiment, by delaying the explosion of the charges 26B by about 9 milliseconds later than the explosion of charges 26A, the side blast is enhanced for more complete destruction of the pillars while generating less vibration.

The primary detonation system 113 also fires the time delay fuses 112 interposed between the detonator and the charges 40. The time delay fuses 112 may be of a longer duration than the fuses 110, perhaps 25 milliseconds or more for example. Certain of the charges 40 are fired after a single delay determined by the fuses 112, while other charges may be fired after a series of delays as where fuses 110 and 112 are connected in series. The staggered detonation of charges 40 assures better breakage and develops less vibration.

The illustrated detonation system 111 includes a safety or back-up detonation system 124 which serves to remove by detonation any charges not exploded by the primary system to prevent unexploded charges from being left in the area. The safety system includes a safety line detonator cord 124' which is connected through a plurality of connectors 120 to the safety branch cords 131. The safety system ignites time delay fuses 114, 116 and 118 which can be of varying duration but which cause delays which are as long or longer than the total of the time delays within the line between charges 40 and/or 26b and the primary detonating cord 122. For example, if the delay of fuses 110 are 9 milliseconds each and the delays of fuses 112 are 25 milliseconds each, then the delays of: (1) fuses 114 would be 25 milliseconds, (2) fuses 116 would be 35 milliseconds and (3) fuses 118 would be 9 milliseconds.

Figure 7:
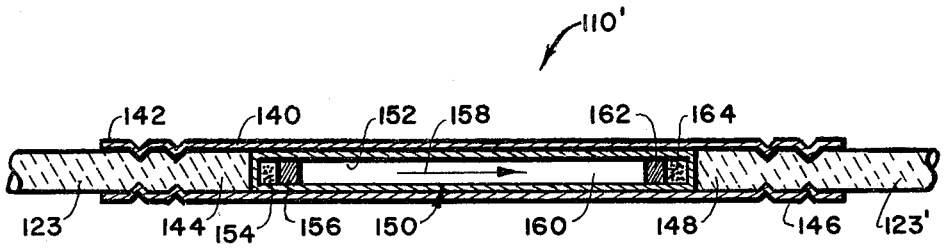
FIG. 7 is a sectional view of one example of a time delay fuse used for timing certain of the explosions.

A typical delay fuse is illustrated in FIG. 7 and is indicated at 110'. This delay fuse serves to delay blasting or detonation of charges connected through it to the detonator. The illustrated delay fuse includes a substantially cylindrical housing 140 having one end portion 142 which is crimped about one end 144 of the branch cord 123'. The opposite end portion 146 of the housing is crimped about the end 148 of the branch cord 123'. The ends 144 and 146 of the detonating branch cord 123' are connected through a delay mechanism 150 such that the transmission of the detonation energy or impulse through the cord 123' can be delayed by a preselected interval. More specifically, the delay mechanism 150 is contained in the cylindrical housing 152 carried by housing 140 such that the opposite ends of the mechanism 150 about respective ends of the cord 123'. In operation, as the detonation energy reaches end 144 of cord 123, a charge 154 is ignited which throws the projectile 156 in the direction of the arrow 158 through the housing passage 160 of a preselected length, thereby causing a delay in the transmission of the detonation energy or impulse. As the projectile 156 strikes the detonator 162 the charge 164 is ignited thereby introducing the detonation impulse back into the cord at its end portion 148. The delay of the detonation impulse transmission through the mechanism 150 can be controlled for timing the detonation of the charges within the holes. One suitable delay connector for use on explosive primer detonator cord is the MS-9 manufactured by the Austin Powder Company, 3735 Green Rd., Cleveland, Ohio 44122.

Although the invention has been described in terms of the illustrated preferred embodiment, many variations and modifications therein will be apparent to those skilled in the art. Accordingly this invention is intended to cover all such variations and modifications which fall within the spirit and scope of the appended claims.

What is claimed is:

1. A method for reclaiming a highwall at a surface mining site having a plurality of elongated holes bored into the face of the highwall, said holes being disposed substantially parallel with respect to each other and extending into a preselected mineral deposit or seam and opening on the face of the highwall, each of said holes being disposed below overburden, above underpinning and separated by pillars of hard mineral deposits, said method comprising the steps of:

placing at least one series of directional charges within said holes, each charge being placed at a preselected location within said hole, and detonating each of said directional charges thereby creating rubble from said highwall, pillars and underpinning.

2. The method for reclaiming a highwall at a surface mining site of claim 1 wherein each of said charges is positioned within the hole on the top surface of the underpinning, said charges being positioned in a substantially upright position, such that the major portion of the expanding gases are released upwardly in a preselected direction thereby maximizing the explosive impact on the overburden at preselected locations.

3. The method for reclaiming a highwall at a surface mining site of claim 2 wherein each of said charges is propped in a substantially upright position.

4. The method for reclaiming a highwall at a surface mining site of claim 1 wherein said series of directional charges are staggered and disposed in a grid configuration having at least two rows, one of said rows of charges being closer to the hole openings than the other row of charges, said grid configuration serving to increase the impacted area and enhance the shearing forces which increase the depth of overburden destroyed proximate the face of the highwall.

5. The method for reclaiming a highwall at a surface mining site of claim 4 wherein said first row of charges is detonated prior to said other row of charges thereby enhancing the shearing forces exerted on the pillars and causing a more complete destruction thereof.

6. The method for reclaiming a highwall at a surface mining site of claims 1, 2, 3, 4 or 5 including the step of removing the foilage from the overburden above the location where the directional charges impact the overburden prior to detonating the charges.

7. A method for reclaiming a highwall at a surface mining site having a plurality of elongated holes bored into the face of the highwall, said holes being disposed substantially parallel with respect to each other and extending into a preselected mineral deposit or seam and opening on the face of said highwall, each of said holes being disposed below overburden, above underpinning and separated by pillars of hard mineral deposits, said method comprising the steps of:

exploding a first series of directional charges positioned at predetermined spaced locations proximate the openings of each of the holes, each of said directional charges being positioned on the floor to each of the holes to maximize the explosive impact on the overburden above each of the charges, such that rubble is created from the overburden above each of the charges, the expanding gases, side shock and flying debris resulting from said first series of directional charges having sufficient force to tear out the pillars from between adjacent holes while expanding sideways and scattering the pillars as rubble on the floors of the holes, thereby tending to so fault the zone and cause collapse of the overburden removing potential water impoundments and creating additional rubble for grading.

8. A method for reclaiming a highwall at a surface mining site having a plurality of elongated holes bored into the face of the highwall, said holes being disposed substantially parallel with respect to each other and extending into a preselected mineral deposit or seam and opening on the face of said highwall, each of said holes being disposed below overburden, above underpinning and separated by pillars of hard mineral deposits, said method comprising the steps of:

exploding a first series of directional charges positioned at predetermined spaced locations proximate the openings of each of the holes, each of said directional charges being positioned to maximize the explosive impact on the overburden above each of the charges, such that rubble is created from the overburden above each of the charges, the expanding gases, side shock and flying debris resulting from said first series of directional charges having sufficient force to tear out the pillars from between adjacent holes while expanding sideways and scattering the pillars as rubble on the floors of the holes the blast from said series of first directional charges traveling toward the rear of each of the holes thereby tending to so fault the zone as to sever the overburden from the underpinning, exploding a further series of charges near the rearward portion of each of the holes each of said charges being positioned to maximize the explosive impact on the overburden above each of said further charges, the explosion of said further series of charges being times such that the expanding gases generated thereby encounter the expanding gases generated from the explosion of said series of first directional charges whereby the synergistic effect of said timed explosions assists in generating a fracture line through said overburden.

9. The method for reclaiming a highwall at a surface mining site of claim 8 wherein each of said charges is positioned within the hole on the top surface of the underpinning, said charges being positioned in a substantially upright position, such that the major portion of the expanding gases are released upwardly in a preselected direction thereby maximizing the explosive impact on the overburden at preselected locations.

10. The method for reclaiming a highwall at a surface mining site of claim 9 wherein each of said charges is propped in a substantially upright position.

11. The method for reclaiming a highwall at a surface mining site of claim 8 wherein said series of directional charges are staggered and disposed in a grid configuration having at least two rows, one of said rows of charges being closer to the hole openings than the other row of charges, said grid configuration serving to increase the impacted area and enhance the shearing forces which tear out the support pillars and further increase the depth of overburden destroyed proximate the face of the highwall.

12. The method for reclaiming a highwall at a surface mining site of claim 11 wherein said first row of charges is detonated prior to said other row of charges thereby enhancing the shearing forces exerted on the pillars and causing a more complete destruction thereof.

13. The method for reclaiming a highwall at a surface mining site of claims 8, 9, 10, 11 or 12 including the step of removing the foilage from the overburden above the location where the directional charges impact the overburden prior to detonating the charges.

14. The method for reclaiming a highwall at a surface mining site of claim 8 including the step of lifting the overburden proximate the location of explosion of the further series of charges with the synergistic effect of said timed explosions such that the highwall front end portion falls onto the floors of holes thereby creating more rubble and grading the rubble created by the falling highwall into a stable ramp.

15. The method for reclaiming a highwall at a surface mining site of claims 1, 7 or 8 including the step of banking a solid material against the hole openings prior to detonating the charges therein such that the air blast and expanding gases are confined within the holes upon explosion of the charges.

16. The method for reclaiming a highwall at a surface mining site of claims 1, 7, 8 or 14 comprising including the steps of drilling a series of blasting media placement holes through the overburden to a preselected depths such that the lower portion of each of the blasting media placement holes are proximate one of the elongated holes bored into the highwall, inserting a charge into each of the blasting media placement holes and positioning each of said charges at the bottom of its respective blasting media placement hole, filling the blasting media placement holes behind the charge therein, and detonating each of the charges in the blasting media placement holes.

17. The method for reclaiming a highwall at a surface mining site of claims 1, 8 or 9 including the step of detonating unexploded charges with a safety detonation system subsequent to the explosion of the first series of charges thereby removing by detonation any charges not previously exploded.

* * * * *